US006866029B1

(12) United States Patent
Clarkson et al.

(10) Patent No.: US 6,866,029 B1
(45) Date of Patent: Mar. 15, 2005

(54) MARINE VESSEL FUEL SYSTEM WITH A FUEL PUMP ATTACHED TO AN EXTERNAL SURFACE OF A FUEL TANK

(75) Inventors: Daniel E. Clarkson, Stillwater, OK (US); Richard C. Todhunter, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 152 days.

(21) Appl. No.: 10/280,174

(22) Filed: Oct. 25, 2002

(51) Int. Cl.[7] ..... F02M 37/04
(52) U.S. Cl. ..... 123/509; 123/514; 440/88 F
(58) Field of Search ..... 123/509, 514, 123/495, 510, 497, 198 R, 511, 470; 137/590, 568.34, 899.2; 440/88 F

(56) References Cited

U.S. PATENT DOCUMENTS

| | | | | | |
|---|---|---|---|---|---|
| 4,699,109 | A | | 10/1987 | Hensel | 123/458 |
| 4,763,633 | A | * | 8/1988 | Nakanishi | 123/514 |
| 4,848,283 | A | | 7/1989 | Garms et al. | 123/73 |
| 5,301,721 | A | * | 4/1994 | Hartmann | 141/59 |
| 5,389,245 | A | | 2/1995 | Jaeger et al. | 210/129 |
| 5,647,331 | A | * | 7/1997 | Swanson | 123/516 |
| 5,855,197 | A | * | 1/1999 | Kato | 123/516 |
| 5,913,294 | A | | 6/1999 | Takahashi et al. | 123/198 |
| 6,056,028 | A | | 5/2000 | Crawford | 141/382 |
| 6,102,011 | A | | 8/2000 | Meyer et al. | 123/509 |
| 6,109,243 | A | | 8/2000 | Seyerle | 123/467 |
| 6,250,287 | B1 | | 6/2001 | Wickman et al. | 123/497 |
| 6,253,742 | B1 | | 7/2001 | Wickman et al. | 123/516 |
| 6,253,790 | B1 | * | 7/2001 | Hara | 137/565.17 |
| 6,298,832 | B1 | * | 10/2001 | Yamazoe et al. | 123/514 |
| 6,453,884 | B2 | * | 9/2002 | Ushigome | 123/509 |
| 6,491,029 | B2 | * | 12/2002 | Kondou et al. | 123/509 |
| 6,655,366 | B2 | * | 12/2003 | Sakai | 123/518 |
| 6,679,229 | B2 | * | 1/2004 | Wada et al. | 123/516 |

* cited by examiner

*Primary Examiner*—Carl S. Miller
(74) *Attorney, Agent, or Firm*—William D. Lanyi

(57) ABSTRACT

A fuel system for a marine vessel attaches a fuel pump directly to the outer surface of a remote fuel tank that is displaced from the internal combustion engine to which the fuel is supplied. A pressure regulator is used to maintain a particular fluid pressure at the outlet of the pump and excess fuel is returned directly into the fuel reservoir. Fuel is drawn upward by the inlet of the pump through a conduit that extends downwardly into fluid communication with liquid fuel within the remote reservoir. A filter can be provided to filter the liquid fuel as it is drawn into the conduit.

19 Claims, 4 Drawing Sheets

MARINE VESSEL FUEL SYSTEM WITH A FUEL PUMP ATTACHED TO AN EXTERNAL SURFACE OF A FUEL TANK

BACKGROUND OF THE INVENTION

1. Field of the Invention

The present invention is generally related to a fuel system for a marine vessel and, more particularly, to a fuel system in which a pump and regulator is attached to an external surface of the fuel tank of the marine vessel.

2. Description of the Prior Art

Many different types of fuel systems are well known for use in conjunction with marine propulsion systems associated with marine vessels.

U.S. Pat. No. 6,253,742, which issued to Wickman et al on Jul. 3, 2001, discloses a fuel supply method for a marine propulsion engine. A method for controlling the operation of a fuel system of an outboard motor uses a lift pump to transfer fuel from a remote tank to a vapor separator tank. Only one level sensor is provided in the vapor separator tank and an engine control unit monitors the total fuel usage subsequent to the most recent filling of the tank. When the fuel usage indicates that the fuel level in the vapor separator tank has reached a predefined lower level, a lift pump is activated to draw fuel from a remote tank and provide that fuel to the vapor separator tank.

U.S. Pat. No. 6,109,243, which issued to Seyerle on Aug. 29, 2000, describes a marine fuel tank pump. The pump comprises a container for assembly into a marine fuel tank. An electric fuel pump is housed in the container. The pump has an inlet receiving fuel from the tank and an outlet. A pressure release is operatively associated with the outlet for releasing pressure from the outlet into the fuel tank when the pump is de-energized.

U.S. Pat. No. 6,102,011, which issued to Meyer et al on Aug. 15, 2000, describes an in-tank fuel delivery system for marine vessels. A fuel delivery system used on marine vessels has a fuel injected, internal combustion engine for propulsion. A fuel tank stores fuel supplied to run the engine through a supply line extending between the fuel tank and the engine. The tank has a relatively small opening, and a fuel pump is sized to fit within the fuel tank through this opening. The fuel pump pumps fuel, under pressure, from the fuel tank to the engine. A fuel filter is also sized to fit within the tank and is connected to an inlet of the fuel pump. Fuel is drawn into the fuel pump through the fuel filter. A pressure regulator regulates the pressure of fuel pumped to the engine. The pressure regulator is mounted externally of the tank and the fuel pump is tethered to the pressure regulator for the fuel pump and fuel filter to be installed in the fuel tank without use of external supporting structure.

U.S. Pat. No. 6,056,028, which issued to Crawford on May 2, 2000, describes a potable fueling apparatus. The device is described wherein fuel is dispensed directly from the vehicle fuel tank by the vehicle fuel pump through the hose of the invention so that a supply of gasoline can be provided for auxiliary engines such as boat, lawn mowers, and the like. A Schrader valve is provided in the fuel line and the portable device of this invention includes a coupling for opening the Schrader valve the end of the hose and a nozzle at the opposite end.

U.S. Pat. No. 5,913,294, which issued to Takahashi et al on Jun. 22, 1999, describes an outboard motor fuel supply system. An outboard motor for a watercraft includes a simply structured fuel supply system of a smaller size and a longer life than prior fuel supply systems. The fuel supply system includes a delivery fuel tank carried by the outboard motor. Fuel is pumped from an external fuel supply tank carried by the watercraft to the delivery fuel tank by a low pressure fuel pump located within the outboard motor. A control system controls the low pressure fuel pump so that a predetermined level of fuel is maintained in the delivery fuel tank. The control system includes a fluid level detection sensor that detects the level of fuel within the delivery fuel tank and produces a corresponding signal indicative of the fuel level. A control unit circuit receives the fluid level signal and determines if the fluid level in the tank is higher or lower than a predetermined maximum fuel level. If the fuel level is determined to be higher than a maximum fuel level, the control unit circuit deactivates the low pressure fuel pump. If the fuel level is determined to be lower than the maximum fuel level, the control unit circuit activates the low pressure fuel pump.

U.S. Pat. No. 5,389,245, which issued to Jaeger et al on Feb. 14, 1995, discloses a vapor separating unit for a fuel system. The vapor separating unit has a particular application to a fuel system for a marine engine. The vapor separating unit includes a closed tank having a fuel inlet through which fuel is fed to the tank by a diaphragm pump. The liquid level in the tank is controlled by a float operated valve. An electric pump is located within the vapor separating tank and has an inlet disposed in the tank and an outlet connected to a fuel rail assembly of the engine. Excess fuel from the fuel rail assembly is conducted back to the upper end of the vapor separating tank. A vapor venting mechanism is incorporated in the tank to vent vapor from the tank.

U.S. Pat. No. 4,848,283, which issued to Garms et al on Jul. 18, 1989, discloses a marine engine with a combination vapor return, crankcase pressure, and cooled fuel line conduit. A marine propulsion system includes a two cycle water cooled crankcase compression internal combustion engine including a vapor separator, a remote fuel tank, and a fuel pump in the tank for delivering fuel to the engine in response to crankcase pulse pressure. A combination conduit between the fuel tank and the engine includes a first passage communicating crankcase pulse pressure from the engine to the fuel pump in the tank, a second passage supplying fuel from the pump in the tank to the engine, a third passage returning fuel vapor from the vapor separator at the engine back to the tank, a fourth passage supplying cooling water from the engine towards the tank, and a fifth passage returning water from the fourth passage back to the engine.

U.S. Pat. No. 6,250,287, which issued to Wickman et al on Jun. 26, 2001, discloses a fuel delivery system for a marine engine. A fuel pump is housed within the structure of a portable fuel tank. The inlet of the pump is located at the lower portion of the tank and an outlet of the pump is connectable in fluid communication with a flexible conduit. An opposite end of the flexible conduit is connectable in fluid communication with the fuel system of an outboard motor. A water sensor and a fuel level sensor can be provided in conjunction with the pump and attached to the pump in certain embodiments. A fuel pressure regulator is connected in fluid communication with the outlet of the pump and also located within the structure of the portable fuel tank.

U.S. Pat. No. 4,699,109, which issued to Hensel on Oct. 13, 1987, discloses a closed end fuel injection system. A marine fuel supply system for a fuel injected engine deadheads a high pressure fuel line with a closed end connection to the fuel injectors without a recirculating return fuel line to the fuel injection pump and without a return fuel line to the remote fuel tank. A differential pressure transducer senses differential pressure across the fuel injector between the high pressure fuel line and the low pressure induction manifold and turns off the fuel pump above a first value of relative differential pressure and turns on fuel pump at a second value below the first value, to maintain the fuel pressure in the high pressure line within a given range relative to induction manifold pressure.

The patents described above are hereby expressly incorporated by reference in the description of the present invention.

In fuel systems for internal combustion engines, particularly in marine propulsion system applications, fuel pumps for drawing fuel from a remote fuel tank and providing that fuel to the engine are typically located either within the remote fuel tank itself or attached to and supported by the engine. In certain marine propulsion systems, such as outboard motors, the fuel pump can be located under the cowl of the outboard motor. In other types of marine propulsion systems, such as sterndrive systems and inboard systems, the fuel pump can be attached directly to the engine or within a remote fuel tank.

It would be significantly beneficial if a fuel system for a marine vessel could be provided in which the fuel pump is located close to the remote fuel tank, but not located within the tank. The placement of the fuel pump close to the remotely stored fuel allows the pump to benefit from close proximity to the liquid fuel, from the cooling temperature of the liquid fuel compared to the fuel being pumped by the fuel pump to the engine, and from the reduced likelihood that vapor lock will occur in the fuel system. It would be beneficial if such a fuel system could also avoid the inherent difficulty associated with locating the fuel pump within the remote tank itself, particularly in situations where many different suppliers of fuel tank are used and the openings formed in the wall of the fuel tank are not easily controlled in size and/or location.

SUMMARY OF THE INVENTION

A fuel system for a marine vessel made in accordance with the preferred embodiment of the present invention, comprises a fuel reservoir and a fuel pump attached to an outer surface of the fuel reservoir, with the fuel pump having an inlet and an outlet. In terms of the description of the present invention, a fuel reservoir is hereby defined as a fuel tank which is remote from an engine of a marine propulsion system, with the fuel pump being displaced from the engine by at least some minimal distance. The present invention further comprises a conduit extending into the fuel reservoir and connected in fluid communication with the inlet of the fuel pump. The fuel system of the present invention also comprises a pressure regulator connected in fluid communication with the outlet of the fuel pump and with the fuel reservoir. The pressure regulator is operable to maintain a preselected magnitude of pressure at the outlet of the fuel pump by returning a portion of the fuel flowing through the fuel pump to the fuel reservoir.

In a particularly preferred embodiment of the present invention, the outer surface of the fuel reservoir is its top surface. The present invention can further comprise a fuel manifold connected in fluid communication with the outlet of the fuel pump. In addition, it can comprise an internal combustion engine, wherein the fuel manifold is connected in fluid communication with a plurality of combustion chambers of the internal combustion engine.

The present invention can further comprise a fuel filter attached to the conduit, within the fuel reservoir, for filtering fuel passing through the conduit from the fuel reservoir to the inlet of the fuel pump. The present invention further comprises a support bracket attached to the outer surface of the fuel reservoir. The support bracket is shaped to retain the fuel pump in a fixed position relative to the fuel reservoir and the support bracket comprises a first fuel passage connected in fluid communication between the outlet of the fuel pump and the fuel manifold.

The support bracket of the present invention can comprise a second fuel passage connected in fluid communication between the outlet of the fuel pump and the fuel reservoir. The distance between the inlet of the fuel pump and the second passage is adjustable. The fuel pump, in a typical application of the present invention, is disposed within one foot of at least a portion of the internal combustion engine.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
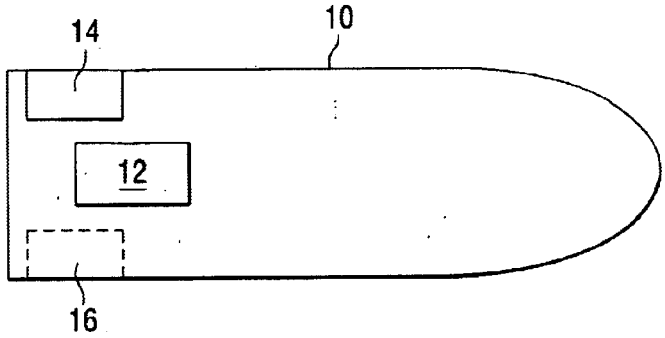
FIG. 1 is a simplified view of a marine vessel with an engine and a remote fuel reservoir.

Throughout the description of the preferred embodiment of the present invention, like components will be identified by like reference numerals.

FIG. 1 is a simplified schematic top view of a marine vessel 10 with an engine 12 that is centrally located near the aft portion of the marine vessel. Reference numeral 14 identifies a remote fuel reservoir that provides liquid fuel to the engine 12. Reference numeral 16 represents the potential position of a second remote fuel reservoir, shown in dashed lines, that could be used to provide additional liquid fuel to the engine 12.

Figure 2:
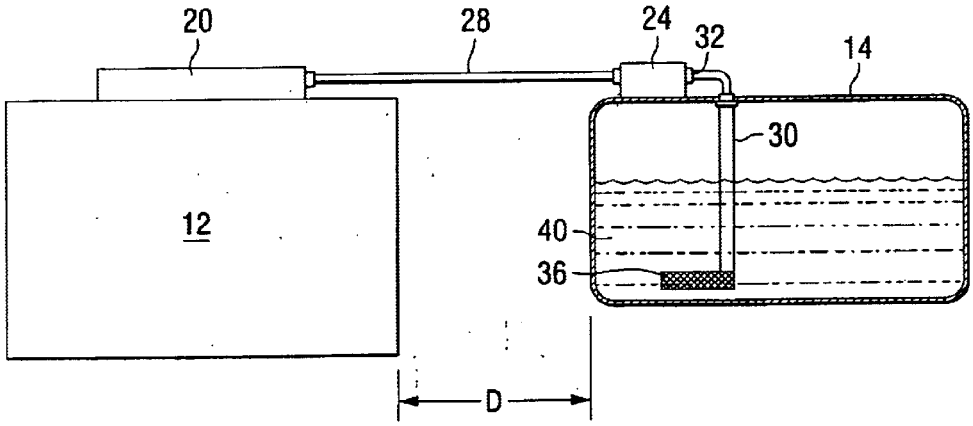
FIG. 2 is a side view of an engine and a fuel reservoir with a fuel system connected therebetween.

FIG. 2 shows the engine 12 and the fuel reservoir 14 displaced from each other by a distance D. Shown schematically on the upper portion of the engine 12 is a fuel rail 20. A fuel pump 24 is attached to the upper surface of the remote fuel tank 14 and connected in fluid communication with the fuel rail 20 by a conduit 28. A conduit 30 extends downwardly into the fuel reservoir 14 from an inlet 32 of the fuel pump 24. The conduit 30 has a fuel filter 36 attached to it for filtering liquid fuel 40 as it passes upwardly through the conduit from the fuel reservoir 14 to the inlet 32 of the fuel pump 24.

Figure 3:
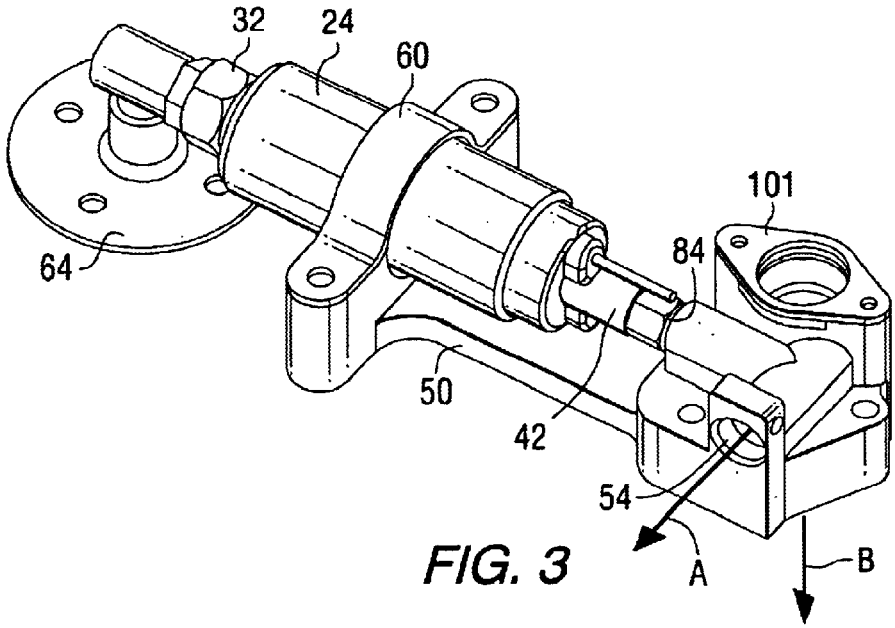
FIG. 3 is an isometric view of the present invention.

FIG. 3 is an isometric representation of the basic components of the present invention. The fuel pump 24 has an inlet 32 and an outlet 42. A support bracket 50 is attachable to the outer surface of the fuel reservoir 14 and is shaped to retain the fuel pump 24 in a fixed position relative to the fuel reservoir 14. The support bracket 50 comprises a first fuel passage 54 which is connected in fluid communication between the outlet 42 of the fuel pump 24 and the fuel manifold 20, which can be a fuel rail of the internal combustion engine 12 described above in conjunction with FIG. 2. The support bracket 50 also comprises a second fuel passage (not visible in FIG. 3) which is connected in fluid communication between the outlet 42 of the fuel pump and the fuel reservoir 14 illustrated in FIG. 2. Arrow A represents the direction of fuel flow through the first fuel passage 54 and arrow B shows the direction of fuel flow through the second fuel passage which will be described in greater detail below. A bracket 60 is used to retain the pump 24 in position on the bracket 50. A flange 64 is attachable to the upper surface of the fuel reservoir 14 and the conduit 30 is supportable by the flange 64 as it extends downwardly into the liquid fuel 40 within the fuel reservoir 14.

Figure 4:
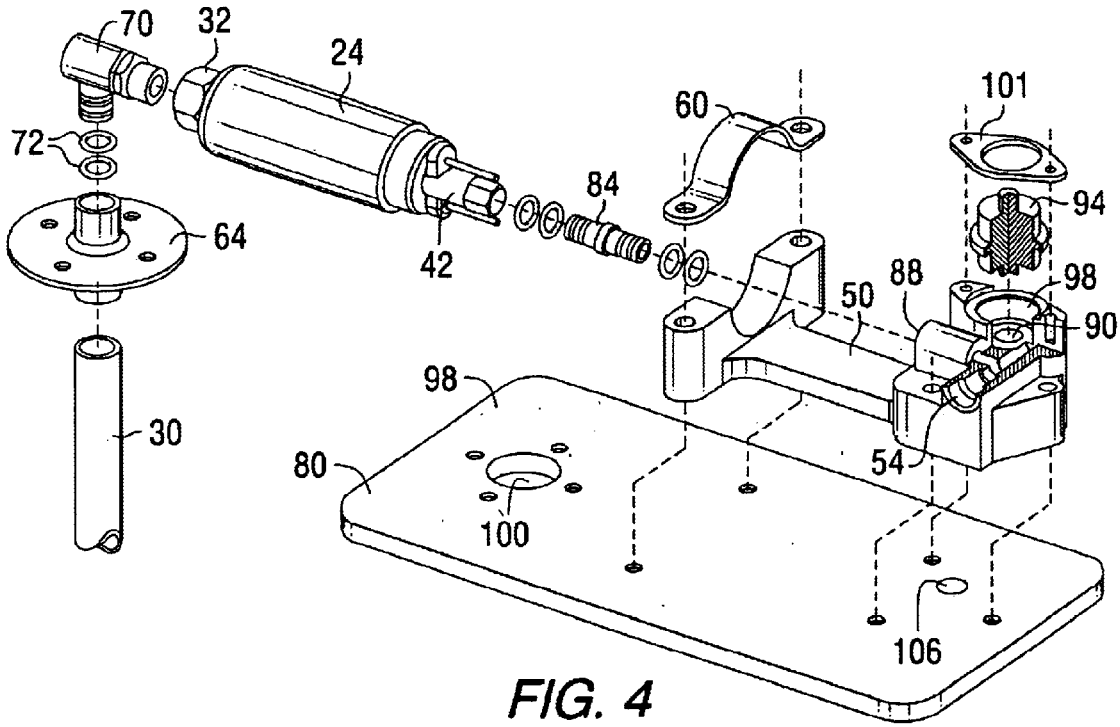
FIG. 4 is an exploded isometric view of the invention including a pressure regulator with certain portions of the present invention sectioned.

FIG. 4 is an exploded view of the present invention shown in FIG. 3. The inlet 32 of the pump 24 is connectable to an elbow 70 which, in turn, is insertable into the flange 64. Two O-rings 72 provide a liquid tight seal between the elbow 70 and the flange 64. The conduit 30 is shown extending downwardly from the flange 64. A portion 98 of the top surface 80 of the fuel reservoir 14, which is shown in FIG. 2, is illustrated in FIG. 4. It should be understood that the total top surface 80 of the fuel reservoir 14 is larger than the portion 98 shown in FIG. 4. The outlet 42 of the pump 24 is provided with an extension conduit 84 that connects the outlet 42 with a fluid passage 88 that is formed as part of the bracket 50. In conjunction with the O-rings, shown in FIG. 4, the extension conduit 84 permits the pump 24 to be appropriately positioned relative to the bracket structure 50 at a variety of positions to accommodate variations in the distance between openings 100 and 106. The first fuel passage 54 is shown in partial section view and in fluid communication with the fluid passage 88. The second fuel passage 90 is shown extending downwardly through the bracket structure 50. A pressure regulator 94 is retained within a cavity 98 formed in the bracket structure 50 by component 101.

With continued reference to FIG. 4, the flange 64 is attached to the upper surface 98 by four fasteners that are extended through the four holes in the flange 64 and into the four holes surrounding the opening 100 formed in the upper surface 98. The conduit 30 is attached to and supported by the flange 64 and extends downwardly through opening 100 into the cavity of the fuel reservoir 14. The bracket 50 is attached to the top surface 80 of the fuel reservoir 14 by fasteners that extend into the five holes in the top surface which are associated with five holes in the bracket 50, as represented by dashed lines. An opening 106 is formed in the top surface to allow fuel to be returned, through the second fuel passage 90, into the fuel reservoir 14 under the control of the pressure regulator 94.

Figure 5:
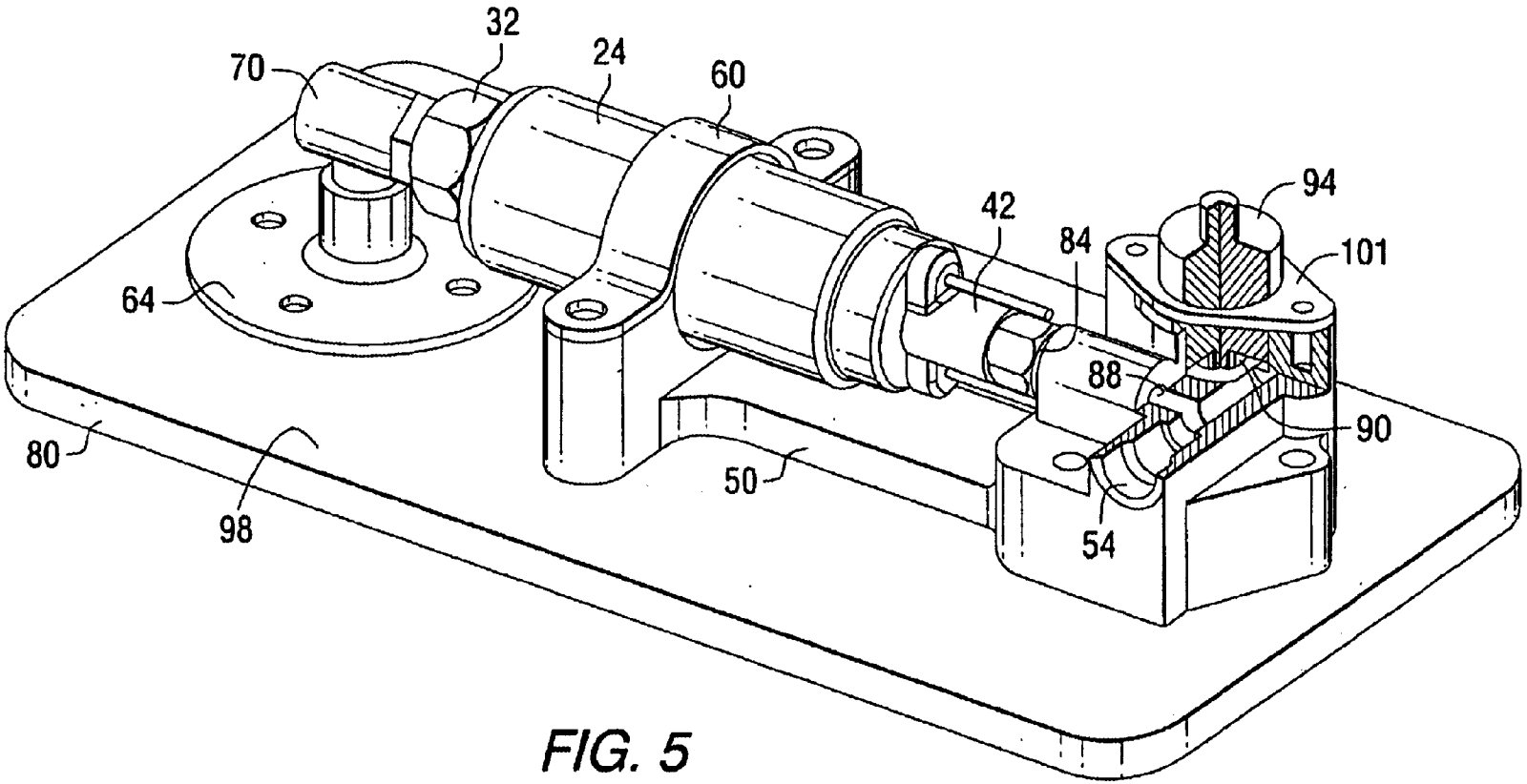
FIG. 5 is an isometric view of the present invention with certain portions sectioned.

FIG. 5 is an isometric view of the present invention mounted on the top surface 80 of a fuel reservoir 14, as illustrated in FIG. 2. A portion of the bracket 50 has been sectioned to show the fuel passage 88 which conducts fuel from the outlet 42 of the pump 24 into fluid communication with the first fuel passage 54, which is connected in fluid communication with the fuel manifold 20, such as a fuel rail, as described above in conjunction with FIG. 2. The conduit 88 from the outlet 42 of the pump 24 is also connected in fluid communication with the second fuel passage 90 that is connected in fluid communication between the outlet 42 of the fuel pump 24 and the fuel reservoir. The extension conduit 84, as described above, allows some flexibility to be used when positioning the pump 24 to accommodate the distance between openings 100 and 106 in the fuel tank. In other words, under the control of the pressure regulator 94, fuel can be returned directly from the outlet 42 of the pump 24 back into the reservoir 14 when the pressure at the outlet 42 of the pump exceeds a preselected magnitude, as determined by the regulator 94. The fuel is directed downwardly through the second fuel passage 90 and return to the liquid fuel 40 within the fuel reservoir 14.

Figure 6:
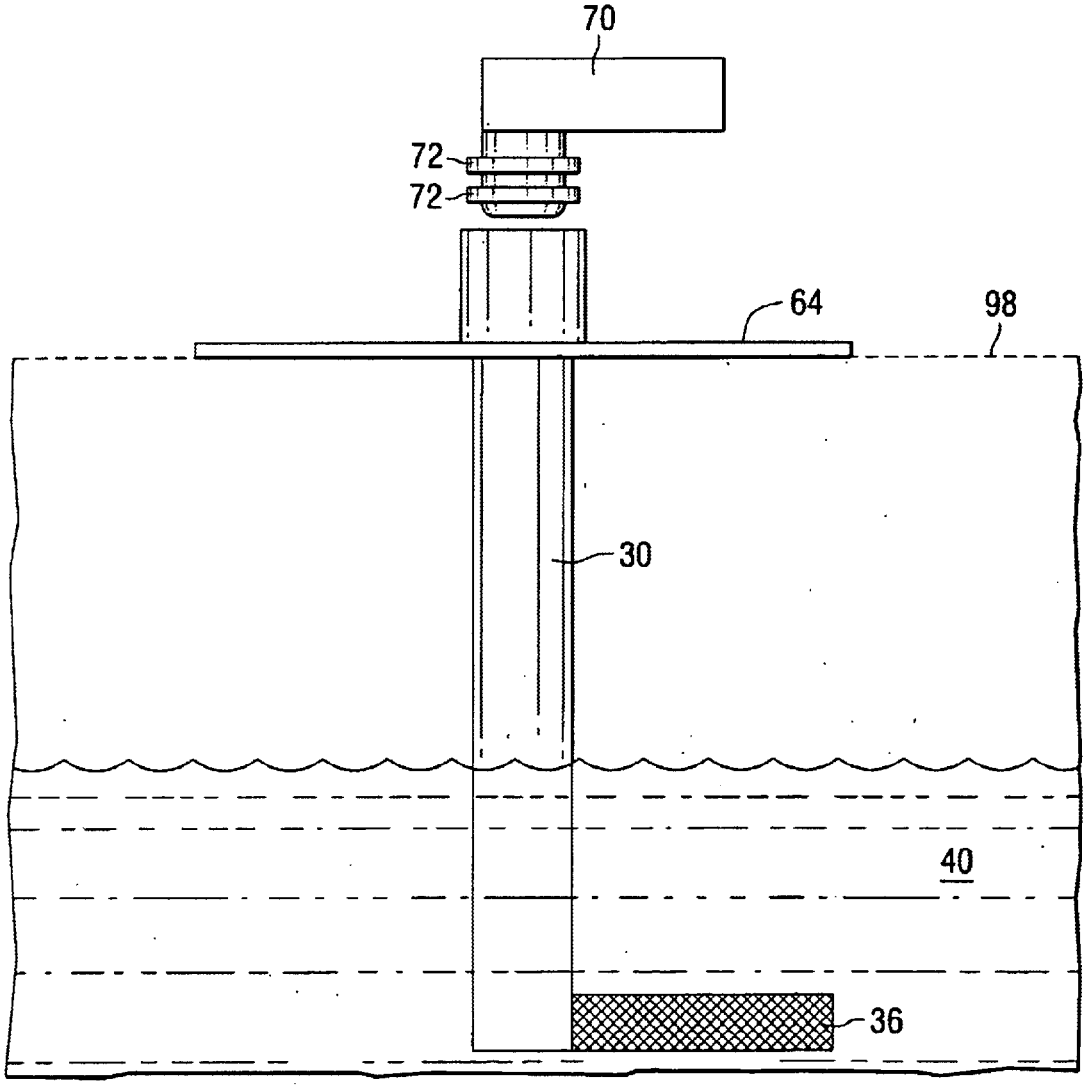
FIG. 6 is a side view of a conduit, flange, filter, and elbow used in conjunction with the present invention.

FIG. 6 is a simplified representation of the conduit 30 which is supported from the flange 64. A filter 36 is attached to the bottom portion of the conduit 30 and disposed under the surface of the liquid fuel 40. In most applications of the present invention, the pump 24 is placed within twelve inches of some portion of the engine 12, as illustrated in FIGS. 1 and 2. This is represented by dimension D in FIG. 2.

Known fuel systems for marine vessels place the fuel pump either inside the cavity of the fuel reservoir 14 or attached directly to the engine 12. When the fuel pump is placed inside the fuel reservoir 14, sufficient space above the fuel reservoir 14 must be provided in order to allow the pump and its associated equipment to be lifted upwardly through an associated opening in the top surface 80 of the fuel reservoir 14. With the pump mounted directly on top of the outer surface of the fuel reservoir 14, this additional space is not required to facilitate the pulling upward of the pump and conduit structure. In addition, pumps that are disposed inside the fuel reservoir 14 are suspended below the upper surface 98. By attaching the pump directly to the upper surface, the present invention increases the structural stability of the fuel system in the region of the reservoir 14. No additional support structure is required for the present invention as compared to the need to support the weight of the pump from the flange 64 in known systems. In addition, the size and shape of the pump in the present invention is not dependant on the size of the fuel reservoir 14 or its various openings since the pump need not be inserted into the inside cavity of the fuel reservoir. By drawing liquid fuel directly from the reservoir 14, no fuel cooler is needed since the body of liquid fuel 40 inside the reservoir 14 provides the fuel that is at its coolest temperature.

Although the present invention has been described with particular specificity and illustrated to show a preferred embodiment, it should be understood that alternative embodiments are also within its scope.

We claim:

1. A fuel system for a marine vessel, comprising:

a fuel reservoir which is contained within a hull of said marine vessel and spaced apart from an engine of said marine vessel;

a fuel pump attached to an outer surface of said fuel reservoir, said fuel pump having an inlet and an outlet, said outer surface being a top surface of said fuel reservoir;

a conduit extending into said fuel reservoir and connected in fluid communication with said inlet of said fuel pump; and a pressure regulator connected in fluid communication with said outlet of said fuel pump and with said fuel reservoir, said pressure regulator being operable to maintain a fluid pressure at said outlet of said fuel pump at a predetermined magnitude by returning a portion of fuel flowing through said fuel pump to said fuel reservoir.

2. The fuel system of claim 1, further comprising:

a fuel manifold connected in fluid communication with said outlet of said fuel pump.

3. The fuel system of claim 1, further comprising:

an internal combustion engine, said fuel manifold being connected in fluid communication with a plurality of combustion chambers of said internal combustion engine.

4. The fuel system of claim 1, further comprising:

a fuel filter attached to said conduit for filtering fuel passing through said conduit from said fuel reservoir to said inlet of said fuel pump.

5. The fuel system of claim 1, further comprising:

a support bracket attached to said outer surface of said fuel reservoir.

6. The fuel system of claim 5, wherein:

said support bracket is shaped to retain said fuel pump in a fixed position relative to said fuel reservoir.

7. The fuel system of claim 5, wherein:

said support bracket comprises a first fuel passage connected in fluid communication between said outlet of said fuel pump and said fuel manifold.

8. The fuel system of claim 7, wherein:

said support bracket comprises a second fuel passage connected in fluid communication between said outlet of said fuel pump and said fuel reservoir.

9. The fuel system of claim 8, wherein:

the distance between said inlet of said fuel pump and said second passage is adjustable.

10. The fuel system of claim 1, wherein:

said fuel pump is disposed within one foot of at least a portion of said internal combustion engine.

11. A fuel system for a marine vessel, comprising:

a fuel reservoir which is contained within a hull of said marine vessel and spaced apart from an engine of said marine vessel;

a fuel pump attached to an outer surface of said fuel reservoir, said fuel pump having an inlet and an outlet;

a conduit extending into said fuel reservoir and connected in fluid communication with said inlet of said fuel pump;

a pressure regulator connected in fluid communication with said outlet of said fuel pump and with said fuel reservoir, said pressure regulator being operable to maintain a fluid pressure at said outlet of said fuel pump at a predetermined magnitude by returning a portion of fuel flowing through said fuel pump to said fuel reservoir; and a support bracket attached to said outer surface of said fuel reservoir, said support bracket being shaped to retain said fuel pump in a fixed position relative to said fuel reservoir.

12. The fuel system of claim 11, wherein:

said support bracket comprises a first fuel passage connected in fluid communication between said outlet of said fuel pump and said fuel manifold; and said support bracket comprises a second fuel passage connected in fluid communication between said outlet of said fuel pump and said fuel reservoir.

13. The fuel system of claim 12, further comprising:

a fuel manifold connected in fluid communication with said outlet of said fuel pump.

14. The fuel system of claim 13, further comprising:

an internal combustion engine, said fuel manifold being connected in fluid communication with a plurality of combustion chambers of said internal combustion engine.

15. The fuel system of claim 14, further comprising:

a fuel filter attached to said conduit for filtering fuel passing through said conduit from said fuel reservoir to said inlet of said fuel pump.

16. The fuel system of claim 15, wherein:

the distance between said inlet of said fuel pump and said second passage is adjustable.

17. The fuel system of claim 16, wherein:

said fuel pump is disposed within one foot of at least a portion of said internal combustion engine.

18. A fuel system for a marine vessel, comprising:

a fuel reservoir which is contained within a hull of said marine vessel and spaced apart from an engine of said marine vessel;

a fuel pump attached to an outer surface of said fuel reservoir, said fuel pump having an inlet and an outlet, said outer surface being a top surface of said fuel reservoir;

a conduit extending into said fuel reservoir and connected in fluid communication with said inlet of said fuel pump;

a pressure regulator connected in fluid communication with said outlet of said fuel pump and with said fuel reservoir, said pressure regulator being operable to maintain a fluid pressure at said outlet of said fuel pump at a predetermined magnitude by returning a portion of fuel flowing through said fuel pump to said fuel reservoir; and a support bracket attached to said outer surface of said fuel reservoir, said support bracket being shaped to retain said fuel pump in a fixed position relative to said fuel reservoir, said support bracket comprising a first fuel passage connected in fluid communication between said outlet of said fuel pump and said fuel manifold, said support bracket comprising a second fuel passage connected in fluid communication between said outlet of said fuel pump and said fuel reservoir.

19. The fuel system of claim 18, further comprising:

a fuel manifold connected in fluid communication with said outlet of said fuel pump;

an internal combustion engine, said fuel manifold being connected in fluid communication with a plurality of combustion chambers of said internal combustion engine;

a fuel filter attached to said conduit for filtering fuel passing through said conduit from said fuel reservoir to said inlet of said fuel pump.

* * * * *